US006746097B2

(12) United States Patent
Im et al.

(10) Patent No.: US 6,746,097 B2
(45) Date of Patent: Jun. 8, 2004

(54) INKJET PRINTER AND MAINTENANCE CONTROL METHOD OF THE SAME

(75) Inventors: Dae-hyeok Im, Suwon (KR); Young-bok Ju, Sungnam (KR); Jin-ho Park, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/214,147

(22) Filed: Aug. 8, 2002

(65) Prior Publication Data

US 2003/0137552 A1 Jul. 24, 2003

(30) Foreign Application Priority Data

Jan. 18, 2002 (KR) ..... 2002-3121

(51) Int. Cl.[7] ..... B41J 2/165

(52) U.S. Cl. ..... 347/23; 347/29; 347/30; 347/33

(58) Field of Search ..... 347/23, 3, 14, 347/19, 22, 24, 29, 30, 33; 358/296, 461, 468

(56) References Cited

U.S. PATENT DOCUMENTS 5,475,404 A 12/1995 Takahashi et al.
5,617,122 A * 4/1997 Numata et al. ..... 347/14
5,856,834 A 1/1999 Murphy, III
6,431,680 B1 * 8/2002 Shinada ..... 347/19

FOREIGN PATENT DOCUMENTS

EP 0803359 10/1997

* cited by examiner

*Primary Examiner*—Shih-Wen Hsieh
(74) *Attorney, Agent, or Firm*—Staas & Halsey LLP

(57) ABSTRACT

A head maintenance control method of an inkjet printer includes receiving a printing command performing a printing operation, calculating a time difference between an input time of the printing command and a final time that the printing operation of the inkjet printer has been most recently performed before the printing command is input, displaying a message requesting the maintenance operation when the time difference is greater than a predetermined time, and performing the maintenance when an execution command for performing the maintenance is input. An intensity of the maintenance operation varies in accordance with the time difference. The maintenance operation is performed in response to an actually required degree when the maintenance should be performed, thus an unnecessary maintenance operation is avoided or an incomplete maintenance operation is prevented. Furthermore, the message requesting the maintenance is informed to the user, thus the user can easily recognize that the maintenance operation is needed and also the user can operate the maintenance operation voluntarily.

29 Claims, 3 Drawing Sheets

FIG.3A

WARNING!!!

THE MOST RECENT PRINTING DATE IS XX/YY/ZZ.
SINCE IT HAS BEEN A LONG TIME, PRINTING QUALITY
CAN BE AFFECTED BY CLOG OF NOZZLE.
TO SOLVE THE PROBLEM, WOULD YOU LIKE A
MAINTENANCE OPERATION?

YES NO

FIG.3B

WARNING!!!

THE MOST RECENT PRINTING TIME WAS 15:30 ON XX/YY/ZZ.
SINCE IT HAS BEEN MORE THAN 10 HOURS, PRINTING QUALITY
CAN BE AFFECTED BY A CLOG OF THE NOZZLE.
TO SOLVE THE PROBLEM, WOULD YOU LIKE A
MAINTENANCE OPERATION?

YES NO

INKJET PRINTER AND MAINTENANCE CONTROL METHOD OF THE SAME

CROSS-REFERENCE TO RELATED APPLICATIONS

This application claims the benefit of Korean Application No. 2002-3121, filed Jan. 18, 2002, in the Korean Industrial Property Office, the disclosure of which is incorporated herein by reference.

BACKGROUND OF THE INVENTION

1. Field of the Invention

The present invention relates to an inkjet printer and a maintenance control method of the same, and more particularly, to an inkjet printer and a maintenance control method of the same informing a user of information about an appropriate time to perform a maintenance operation and of performing the maintenance operation at the appropriate time.

2. Description of the Related Art

An inkjet printer is an apparatus printing an image by ejecting ink on paper in response to input data and usually has a head with a plurality of nozzles ejecting the ink. While the nozzles of the head eject the ink repeatedly during printing, the nozzles sometimes cannot normally eject the ink due to deterioration or other reasons. When one of the nozzles cannot normally eject the ink, the quality of the printing may not be satisfactory, and even a white line appears on a printed image.

To prevent the above malfunction of the nozzles, a maintenance operation of the head is performed. The maintenance, operation includes a spitting operation enabling the nozzles to eject the ink, a wiping operation wiping a residue of the ink on a portion of the nozzles, a capping operation capping the nozzles, and a suction operation drawing the ink from the nozzles. When some or all operations among the above operations are performed, the residue of the ink is removed from the nozzles, and thus the ink is easily ejected through the nozzles.

The above maintenance operation is performed when a certain condition is met. In a conventional inkjet printer, the maintenance operation is performed when power is cut and again supplied, when a user inputs an execution command performing the maintenance operation before printing on each page in a printing operation, and when the user thinks that the printing operation is not performed for a predetermined time period.

A method of performing the maintenance operation is set up differently in accordance with each condition. For example, when the power is supplied, the wiping operation is performed once, the spitting operation is performed several times, and both the wiping and spitting operations are repeated twice. When the user inputs the execution command, the wiping operation is performed once, the spitting is performed several times, and both the wiping and spitting operations are repeated three times. When the printing operation is performed on each page, the wiping operation is performed once, the spitting operation is performed several times, and both the wiping and spitting operations are performed once.

However, according to the conventional maintenance control method, the maintenance operation is performed regardless of a period of the power cut when the maintenance operation is performed at the time of the power supply to the inkjet printer. Thus, there is a problem that an incomplete maintenance operation with less intensity (degree) than actually required may be performed. Accordingly, the printing operation can be performed even in a state that the nozzles are clogged, which causes the deterioration of a printing quality and the waste of paper.

Moreover, when the maintenance operation is performed when required by the user, the user has to know about a non-printing period that the printing operation is not performed so as to perform the actually desired maintenance operation. Furthermore, even if the user knows the non-printing period that the printing operation is not performed, it is hard for the user to recognize an operation degree of the maintenance operation corresponding to the non-printing period. Therefore, an unnecessary maintenance operation might be performed, or the maintenance operation is performed less than actually required.

SUMMARY OF THE INVENTION

The present invention has been made to overcome the above and other problems of the related art. Accordingly, it is the object of the present invention to provide an inkjet printer and a maintenance control method of the same allowing a user to voluntarily operate a maintenance operation when the user recognizes a need of the maintenance operation by being informed of the need of the maintenance operation of the printer.

Another object of the present invention is to provide an inkjet printer and a maintenance control method of a head of the same capable of preventing an overtime or less time maintenance operation by allowing the maintenance operation to be performed as much as the maintenance operation is actually required.

Additional objects and advantages of the invention will be set forth in part in the description which follows and, in part, will be obvious from the description, or may be learned by practice.

The above and other objects may be achieved by providing a maintenance control method of a head of an inkjet printer according to an embodiment of the present invention. The maintenance control method includes receiving a printing command to perform a printing operation, calculating a time difference between an input time of the printing command and a final time that the printing operation of the inkjet printer has been finally or most recently performed before the printing command is input, and performing at least one of a maintenance operation of the head and a displaying operation displaying a message requesting the maintenance operation when the time difference is greater than a predetermined time period before the printing operation of the inkjet printer is performed in response to the printing command.

The maintenance operation includes at least one of spitting, wiping, capping and suction operations of nozzles in the head. In addition, the predetermined time period is approximately 10 hours.

Additionally, the maintenance control method includes detecting whether an electrical power is supplied to the inkjet printer, and performing the maintenance operation of the head when the supply of the electrical power is detected. Therefore, the maintenance operation is performed in response to the time difference and the power supply.

Moreover, the maintenance operation is performed when an execution command performing the maintenance operation is input from an outside of the inkjet printer after the displaying operation is performed. Accordingly, the user can use the printer more conveniently and efficiently as the maintenance operation is performed when the user receives a message and inputs the execution command voluntarily.

In addition, the greater the time difference is, the greater an intensity (degree) of the maintenance operation is.

The inkjet printer includes a head having a plurality of nozzles ejecting ink, a maintenance unit performing a maintenance operation of the head, an interface receiving printing data and a printing command performing a printing operation from a host, and a control unit calculating a time difference between an input time of the printing command and a final time that the printing operation has been finally or most recently performed by the head when the printing command is input through the interface. The control unit controls the maintenance unit to perform the maintenance operation before the head prints printing data received through the interface when the time difference is greater than a predetermined time period.

Here, the message is displayed on a display unit, and the execution command performing the maintenance operation is input through an input unit.

The maintenance operation is performed as much as the maintenance operation is actually required, and thus, the unnecessary maintenance or less intensified maintenance operation can be prevented. Moreover, the user can easily recognize whether the maintenance operation is required through the displayed message.

BRIEF DESCRIPTION OF THE DRAWINGS

These and other objects and advantages of the invention will become apparent and more readily appreciated from the following description of the preferred embodiments, taken in conjunction with the accompany drawings of which:

FIGS. 3A and 3B are views showing message screens displayed on a display unit of FIG. 1.

DETAILED DESCRIPTION OF THE PREFERRED EMBODIMENTS

Figure 1:
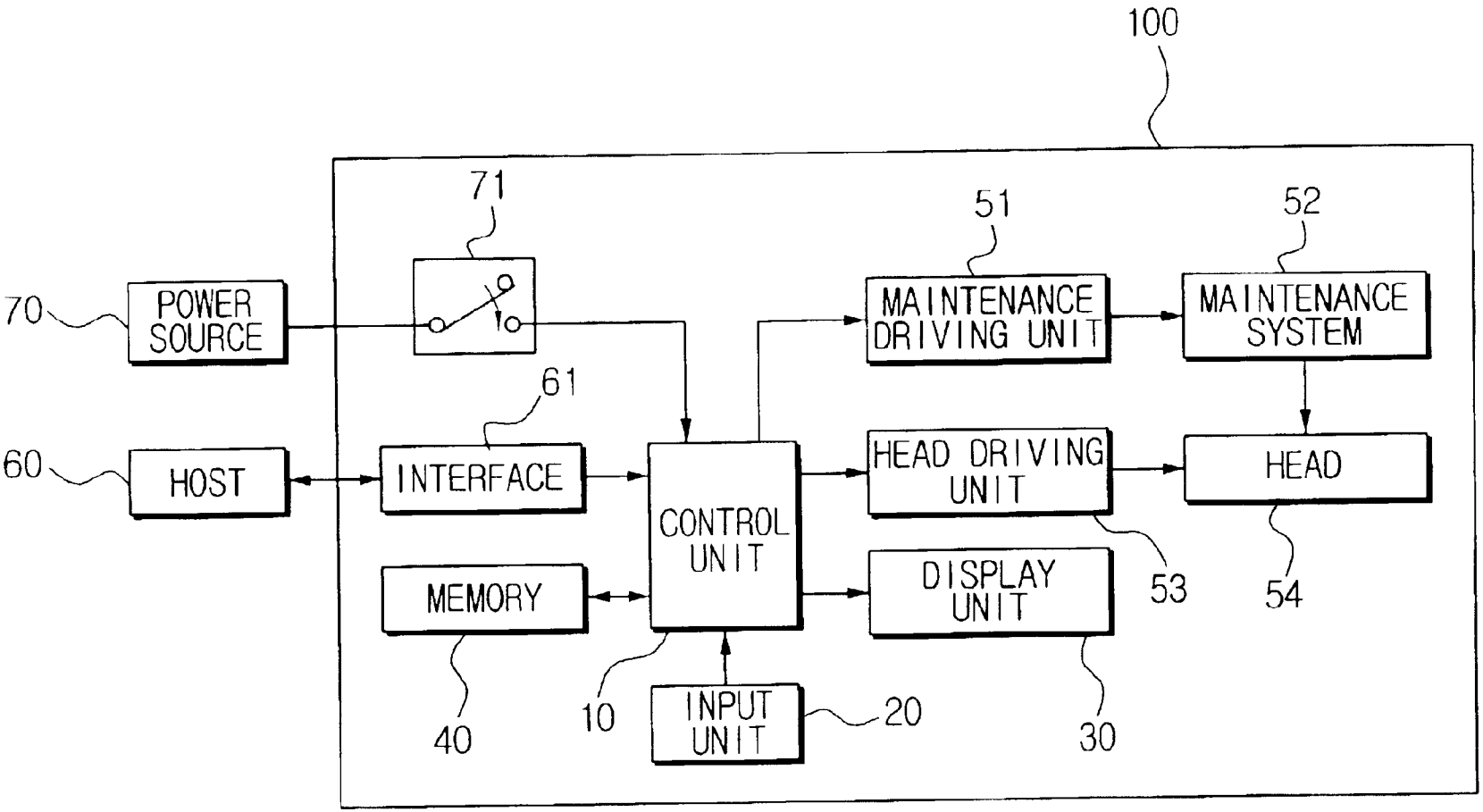
FIG. 1 is a block diagram showing an inkjet printer according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

FIG. 1 is a block diagram showing an inkjet printer according to an embodiment of the present invention. The inkjet printer 100 comprises a head 54 having a plurality of nozzles, a maintenance system 52 performing a maintenance operation of the head 54, an interface 61 interfacing with a host 60, a memory 40 storing information about printed data or files, a display unit 30 displaying a certain message, an input unit 20 inputting an execution command performing the maintenance operation, a power switch 71 controlling power supplied from an external power source 70, and a control unit 10 controlling a printing operation and the maintenance operation.

The power supplied from the power source 70 through the power switch 71 is supplied to each part of the inkjet printer 100.

The inkjet printer 100 is connected with the host 60, such as a computer, through the interface 61. After a printing command and/or printing data is generated from the host 60, the printing command and/or the printing data is transmitted to the control unit 10 through the interface 61 in a printing operation.

The control unit 10 drives the head 54 through a head driving unit 53. In other words, when the printing command and the printing data are input to the control unit 10, then the control unit 10 drives the head 54 to print the printing data on a paper. Accordingly, the printing data is printed on the paper when the nozzles of the head 54 are controlled to eject ink on the paper in accordance with the printing data. Moreover, the control unit 10 performs a spitting operation among several maintenance operations through the head driving unit 52. The spitting operation is performed by the nozzles of the head 54 which are controlled to eject the ink on the paper in response to a spitting command of the control unit 10.

The control unit 10 also drives the maintenance system 52 through a maintenance driving unit 51. The maintenance system 52 performs wiping, capping, and suction operations except the spitting operation among the above-described maintenance operations.

A list of the printing data printed through the head 54 is stored in the memory 40. In other words, after the control unit 10 performs the printing operation by driving the head 54 according to the transmitted printing command and printing data, the control unit 10 records information about the printed printing data into the memory 40. At this time, the printing information includes a file name of the printing data, the number of printed pages, a printing time (or possibly date) of the printing operation, etc. The file name or the number of the printed pages does not necessarily have to be recorded, but the printing time must be recorded.

The display unit 30 displays a message requesting the maintenance operation when there is a need to perform the maintenance operation. In other words, the control unit 10 displays the message through the display unit 30 when conditions described in a later part of this description are met. The display unit 10 may be an LCD display.

The user inputs the execution command performing the maintenance operation through the input unit 20. In other words, when the user inputs the execution command performing the maintenance operation through the input unit 20, then the execution command is transmitted to the control unit 10, and the control unit 10 performs the maintenance operation of the nozzles of the head 54 by controlling the maintenance driving unit 51 and/or the head driving unit 53 in response to the execution command.

Figure 2:
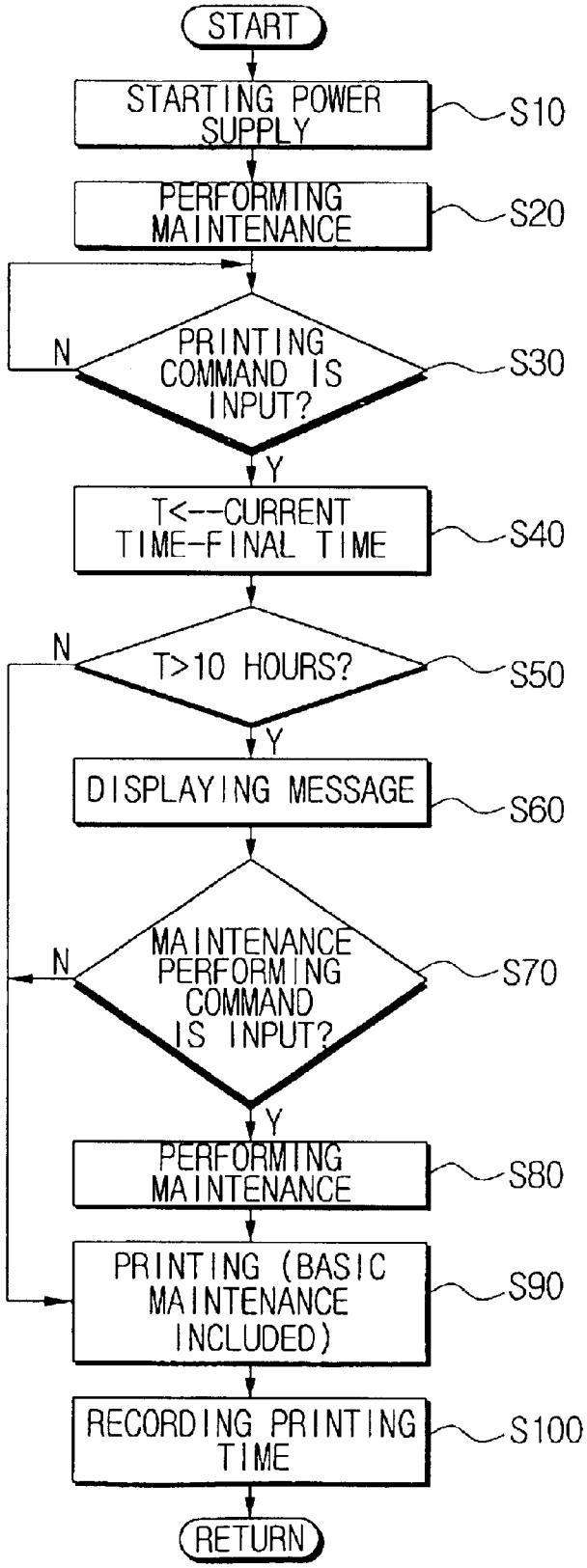
FIG. 2 is a flow chart showing a maintenance control method performed by the inkjet printer of FIG. 1.

Herein below, A maintenance control method of the inkjet printer of FIG. 1 will be described in greater detail by referring to FIGS. 2 and 3.

When the power switch 71 of the inkjet printer 100 is turned on in operation S10, the control unit 10 performs a basic maintenance operation in operation S20. At this time, the basic maintenance operation is performed by, for example, wiping the nozzle once and spitting the ink twice. However, in the case that the power is supplied by turning on the power switch 71, the above operations S10 and S20 performing the basic maintenance operation can be omitted according to another embodiment of the present invention.

When the printing command is transmitted from the host 60 in operation S30, the control unit 10 retrieves a final time or date of the printing operation most recently (finally) performed by the inkjet printer 100 before the printing command is input, based on the data stored in the memory 40, and calculates a time difference T between the final time and an input current time of the printing command in operation S40. The control unit 10 determines whether the time difference T is greater than a predetermined time, for example 10 hours in operation S50. When the time difference T is not greater than the predetermined time, the control unit 10 drives the head 54 to print the printing data transmitted from the host 60 in operation S90.

When the time difference T is greater than the predetermined time, such as 10 hours, the control unit 10 displays the message requesting the maintenance operation of the head 54 through the display unit 30 operation S60. FIGS. 3A and 3B show the message displayed through the display unit 30. As shown in FIGS. 3A and 3B, the message includes information about the final time and whether the execution command to perform the maintenance operation is input. The message of FIG. 3A shows the most recent printing date, and the message of FIG. 3B informs the user of both the most recent printing time and the time difference.

When the user inputs the execution command to perform the maintenance operation through the input unit 20 in operation S70, the execution command is transmitted to the control unit 10, and the control unit 10 performs the maintenance operation by driving the maintenance system 52 and/or the head 54 in operation S80. The maintenance operation is performed by, for example, repeating the three time spitting and one time wiping operations twice.

The maintenance operation is performed so that the repeating of the maintenance operation is performed more than twice in response to the time difference T, that is, the greater the time difference T is, the greater an intensity (degree) of the maintenance operation is. For example, when the time difference T is over 20 hours, the three time spitting and one time wiping operations are repeated four times.

When the maintenance operation is completed, the control unit 10 prints the printing data transmitted from the host 60 on the paper by driving the head 54. While the head 54 is performing the printing operation in operation S90, a basic maintenance operation is performed. For example, as described before in the description of the prior art, whenever the printing is operated on every page, the wiping operation is performed once and the spitting operation is performed several times.

When the printing operation is completed, the control unit 10 records the printing time of the completed printing data to the memory 40 in operation S100. The recorded printing time is used again as a new final time when a next printing command is input.

In this embodiment of the present invention, the inkjet printer 100 includes the input unit 20, the memory 40, and the display unit 30 to perform all functions relating to the maintenance operation. Yet, some or all functions can be performed by the host 60, and some or all of the input unit 20, the memory 40, and the display unit 30 are installed in the host 60. In other words, the above functions can be included in a printer drive installed in the host 60.

For example, the message can be displayed on a separate displaying apparatus installed in the host 60 by transmitting message data to the host 60 to to display the message on the separate displaying apparatus of the host 60 through the interface 61 without displaying the message through the display unit 30. Accordingly, the user can be informed whether the maintenance operation of the inkjet printer 100 is required while working with a personal computer of the host 60.

Moreover, the execution command requesting the maintenance operation and/or the printing operation can be input by using the host 60 without inputting the execution command through the input unit 20 after the message is displayed.

In addition, the final time can be stored in a memory of the host 60, which actually generates the execution command, without being stored in the memory 40. For example, the printer drive of the host 60 has a function of managing the printing command transmitted from a control portion of the host 60 and storing a history of printing information including the final time. Accordingly, the printing information about the name, type, amount, or printing time of the printed printing data is stored in the printer drive as a database. When the printing command is transmitted from the host 60, some or all printing information are transmitted to the inkjet printer 100, and the control unit 10 can obtain the final time based on the transmitted printing information. Thus, the above-described maintenance operation can be performed.

Therefore, as every operation of controlling the maintenance operation is performed by using the host 60, in other words, as the final time is transmitted from the host 60 to the inkjet printer 100, the message is transmitted from the inkjet printer 100 to the host 60, and the execution command is inputted after the message is displayed is transmitted from the host 60 to the inkjet printer 100. The maintenance operation can be implemented in the inkjet printer 100 and the host 60 without requiring a separate hardware. Accordingly, the user can properly control the maintenance operation by using the host 60, and thus the convenience of the maintenance operation will be improved.

According to the present invention, the maintenance operation is performed based on the time difference between the final time of the most recently performed printing operation and the current time to perform a current printing operation. At this time, the greater the time difference is, the greater the intensity of the maintenance operation is. Therefore, the maintenance operation is performed in accordance with an actually required degree of the maintenance operation when the maintenance operation should be performed. An unnecessary maintenance operation can be avoided or an incomplete maintenance operation is prevented.

Furthermore, the message requesting the maintenance operation is provided to the user before the printing operation, and thus the user can easily recognize that the maintenance operation is needed and also the user can control and perform the maintenance operation voluntarily.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A maintenance control method in an inkjet printer having a head with a plurality of nozzles, comprising:

receiving a printing command performing a printing operation;

calculating a time difference between an input time of the printing command and a final time that the printing operation of the inkjet printer has been most recently performed before the printing command is input; and performing at least one of a maintenance operation of the nozzles of the head and a displaying operation displaying a message requesting the maintenance operation in response to the calculated time difference before the printing operation of the inkjet printer is performed.

2. The maintenance control method of claim 1, wherein the maintenance operation comprises at least one of spitting, wiping, capping and suction operations of the nozzles of the head.

3. The maintenance control method of claim 1, wherein the maintenance operation is performed when the calculated time difference is approximately 10 hours.

4. The maintenance control method of claim 1, further comprising:

detecting whether an electrical power is supplied to the inkjet printer; and performing the maintenance operation of the head when the supply of the electrical power is detected.

5. The maintenance control method of claim 1, wherein the performing of the one of the maintenance operation and the displaying operation comprises:

performing the displaying operation if the calculated time difference is greater than a predetermined time period; and performing the maintenance operation after the displaying operation.

6. The maintenance control method of claim 5, further comprising:

receiving an execution command performing the maintenance operation from an outside of the inkjet printer after the displaying operation is performed, wherein the maintenance operation is performed in response to the execution command.

7. The maintenance control method of claim 1, wherein the inkjet printer comprises a host disposed outside and coupled to the inkjet printer, and the displaying operation of the message is performed by the host when the message is transmitted from the inkjet printer to the host.

8. The maintenance control method of claim 7, further comprising:

receiving an execution command performing the maintenance operation from the host; and performing the maintenance operation in response to the execution command.

9. The maintenance control method of claim 1, wherein an intensity of the maintenance operation is proportional to the calculated time difference.

10. An inkjet printer comprising:

a head having a plurality of nozzles ejecting ink;

a maintenance unit performing a maintenance operation of the head;

an interface receiving printing data and a printing command performing a printing operation;

a control unit calculating a time difference between an input time of the printing command and a final time that the printing operation has been most recently performed by the head when the printing command is input, controlling the maintenance unit so as to perform the maintenance operation before the head prints the printing data when the time difference is greater than a predetermined time period and;

a display unit displaying a message requesting a user to perform the maintenance operation of the head, wherein the message is displayed in response to the time difference being greater than the predetermined time period.

11. The inkjet printer of claim 10, further comprising an input unit allowing a user to input an execution command to perform the maintenance operation, wherein the control unit controls the maintenance unit so that the maintenance operation is performed when the execution command is input through the input unit after the message is displayed on the display unit.

12. An inkjet printer comprising:

a head having a plurality of nozzles ejecting ink;

a maintenance unit performing a maintenance operation of the head;

an interface receiving printing data and a printing command performing a printing operation;

a control unit calculating a time difference between an input time of the printing command and a final time that the printing operation has been most recently performed by the head when the printing command is input, controlling the maintenance unit so as to perform the maintenance operation before the head prints the printing data when the time difference is greater than a predetermined time period;

a host; and an interface to couple the control unit and the host, wherein the control unit transmits a message requesting the maintenance operation of the head to the host through the interface when the time difference is greater than the predetermined time period.

13. The inkjet printer of claim 12, wherein the control unit controls the maintenance unit so that the maintenance operation is performed when an execution command performing the maintenance is input from the host after transmitting the message to the host.

14. An inkjet printer having a head with a plurality of nozzles, comprising:

a maintenance unit performing a maintenance operation of the head; and a control unit controlling the head to perform a first printing operation and a second printing operation in order, detecting a final time of the first printing operation, which has been performed before the second printing operation, and an input time of the second printing operation to be performed after the first printing operation has been performed, detecting a time difference between the final time and the input time, controlling the maintenance unit to perform the maintenance operation in response to the time difference, wherein the control unit transmits time data corresponding to the input time and the final time to the host, and the host calculates the time difference, comprises a displaying apparatus and generates a message to be displayed on the displaying apparatus in response to the time difference; and a host disposed outside the inkjet printer to be coupled to the controller and to generate a printing command performing the second printing operation, and the control unit detects the input time when receiving the printing command from the host.

15. An inkjet printer having a head with a plurality of nozzles, comprising:

a maintenance unit performing a maintenance operation of the head;

a control unit controlling the head to perform a first printing operation and a second printing operation in order, detecting a final time of the first printing operation, which has been performed before the second printing operation, and an input time of the second printing operation to be performed after the first printing operation has been performed, detecting a time difference between the final time and the input time, controlling the maintenance unit to perform the maintenance operation in response to the time difference; and a displaying unit, wherein the control unit controls the displaying unit to display a message when the time difference is greater than a predetermined time period.

16. The inkjet printer of claim 15, wherein the predetermined time period is approximately 10 hours.

17. An inkjet printer having a head with a plurality of nozzles, comprising:

a host disposed outside the inkjet printer to generate first printing data, a first printing command performing a first printing operation corresponding to the first printing data, second printing data, and a second printing command performing a second printing operation corresponding to the second printing data;

a maintenance unit disposed within the inkjet printer to perform a maintenance operation of the head; and a control unit disposed within the inkjet printer to control the head to perform the first printing operation and the second printing operation, detecting a final time when the first printing operation has been performed and an input time when the second printing operation is performed, calculating a time deference between the final time and the input time, and controlling the maintenance unit to perform the maintenance operation in response to the time difference.

18. The inkjet printer of claim 17, wherein the controller detects the final time and the input time when received the first printing command and the second printing command from the host, respectively.

19. The inkjet printer of claim 17, wherein the controller detects the input time when the inkjet printer is turned on after having been turned off.

20. The inkjet printer of claim 17, wherein the controller comprises a displaying unit displaying a message to request a user to control the maintenance unit to perform the maintenance operation before the second printing operation when the time difference is greater than a reference value.

21. The inkjet printer of claim 17, wherein the host comprises a displaying unit and receives the time difference from the controller, and the host displays a message to request a user to control the maintenance unit to perform the maintenance operation before the second printing operation when the time difference is greater than a reference value.

22. An inkjet printer having a head with a plurality of nozzles, comprising:

a host disposed outside the inkjet printer to generate first printing data, a first printing command performing a first printing operation corresponding to the first printing data, second printing data, and a second printing command performing a second printing operation corresponding to the second printing data, receiving a final time and an input time from the inkjet printer, calculating a time deference between the final time and the input time, and generating a maintenance command when the time difference is greater than a reference value;

a maintenance unit disposed within the inkjet printer to perform a maintenance operation of the head; and a control unit disposed within the inkjet printer to control the head to perform the first printing operation and the second printing operation, generating the final time when the first printing operation has been performed and the input time when the second printing operation is performed, and controlling the maintenance unit to perform the maintenance operation in response to the maintenance command.

23. An apparatus for an inkjet printer having a head with a plurality of nozzles, controlling the head to perform a first printing operation, a second printing operation, and a maintenance operation, generating a power on signal and a power off signal when the inkjet printer is turned on and off, comprising:

a host disposed outside the inkjet printer to be coupled to the inkjet printer, detecting whether the inkjet printer is turned on and off in response to the power on and off signals, generating first printing data and a first printing command performing the first printing operation corresponding to the first printing data, and generating second printing data and a second printing command performing the second printing operation corresponding to the second printing data, detecting a final time when the first printing operation is performed and an input time when the second printing command is generated, calculating a time difference between the final time and the input time, and generating a maintenance command to control the inkjet printer to perform the maintenance operation.

24. The apparatus of claim 23, wherein the inkjet printer generates a power on signal and a power off signal when the inkjet printer is turned on and off, and the host detects the final time in response to the power off signal and the input time of the second printing command in response to the power on signal.

25. The apparatus of claim 23, wherein the host calculates the time difference upon receipt of the power off signal and the power on signal of the inkjet printer.

26. The apparatus of claim 23, wherein the host comprises a memory storing the final time, the input time, and the time difference.

27. A maintenance control method in an inkjet printer having a head with a plurality of nozzles, comprising:

receiving a printing command performing a current printing operation;

detecting an input time when the printing command is received and a final time representing when a previous printing operation of the inkjet printer has been most recently performed before the printing command is received;

calculating a time difference between the input time and the final time; and performing a maintenance operation of the nozzles of the head in response to the time difference.

28. The method of claim 27, further comprising:

controlling the performing of the maintenance operation in response to an amount of the time difference.

29. The method of claim 27, wherein the maintenance operation comprises at least one of spitting, wiping, capping and suction operations of the nozzles of the head, and the performing of the maintenance operation comprises modifying the maintenance operation to increase a number of the spitting, wiping, capping and/or suction operations in response to an increase in the amount of the time difference.

* * * * *